US008215485B2

(12) United States Patent
Maroofian et al.

(10) Patent No.: US 8,215,485 B2
(45) **Date of Patent: *Jul. 10, 2012**

(54) DISPLAY AND STORAGE CONTAINER

(75) Inventors: Ira Maroofian, Woodland Hills, CA (US); Tim Oberloier, South Gate, CA (US)

(73) Assignee: PWP Industries, Vernon, CA (US)

( * ) Notice: Subject to any disclaimer, the term of this patent is extended or adjusted under 35 U.S.C. 154(b) by 159 days.

This patent is subject to a terminal disclaimer.

(21) Appl. No.: 12/038,765

(22) Filed: Feb. 27, 2008

(65) Prior Publication Data

US 2009/0211941 A1 Aug. 27, 2009

(51) Int. Cl.
*B65D 85/00* (2006.01)

(52) U.S. Cl. ..... 206/445; 206/508; 206/511; 220/4.23; 220/839

(58) Field of Classification Search ..... 206/445, 206/509, 511, 508, 822, 807, 564, 562, 563, 206/490, 470, 705, 551, 762, 764, 765, 774; 220/4.21, 4.22, 4.23, 4.24, 837, 839, DIG. 13; D9/425, 429; 426/128; 229/406, 906, 938
See application file for complete search history.

(56) References Cited

U.S. PATENT DOCUMENTS

| | | | | |
|---|---|---|---|---|
| 2,256,723 | A | 6/1939 | Nutt | |
| 2,715,458 | A * | 8/1955 | Polglase | 206/394 |
| 3,128,030 | A * | 4/1964 | Davies | 229/406 |
| 3,164,478 | A * | 1/1965 | Bostrom | 426/119 |
| 3,306,462 | A * | 2/1967 | Da Cruz | 211/49.1 |
| 3,372,812 | A * | 3/1968 | Parcels | 211/59.4 |
| 3,376,046 | A * | 4/1968 | Kivett et al. | 280/33.998 |
| 3,410,698 | A * | 11/1968 | Sosin | 426/106 |
| D227,226 | S * | 6/1973 | Stanford | D9/425 |
| 3,740,238 | A * | 6/1973 | Graham | 26/124 |
| 3,937,389 | A * | 2/1976 | Wind | 229/406 |
| 4,014,450 | A | 3/1977 | Girotti et al. | |
| D267,911 | S * | 2/1983 | Long et al. | D6/630 |
| 4,576,330 | A * | 3/1986 | Schepp | 220/315 |
| D287,545 | S * | 1/1987 | Long et al. | D6/630 |
| 4,640,416 | A * | 2/1987 | Northrup et al. | 206/425 |
| 4,844,263 | A * | 7/1989 | Hadtke | 206/508 |
| D308,826 | S | 6/1990 | Cyr et al. | |
| 5,009,312 | A * | 4/1991 | Leben | 206/387.15 |
| 5,046,659 | A * | 9/1991 | Warburton | 220/4.22 |

(Continued)

FOREIGN PATENT DOCUMENTS

EP 380321 A1 * 8/1990

(Continued)

OTHER PUBLICATIONS

"Cookie Container", by Sweetheart Plastic, Figure 1 and Figure 2 filed in Pub. No. US 2001/0002268, Sep. 27, 1999.*

(Continued)

*Primary Examiner* — David Fidei
(74) *Attorney, Agent, or Firm* — Baker Botts LLP

(57) ABSTRACT

A container comprises a clamshell-like shape. The container includes a hinge positioned low on a viewing face and opens high on the rear end. The interior of the container is shaped so as to present its contents at a desirable viewing angle, the container intended to provide an unobstructed view through the viewing face. The container may comprise a closing mechanism at the rear end to hold the container closed. The container can contain products for sale, including cookies, slices of pound cake, other baked goods, and other products.

29 Claims, 11 Drawing Sheets

U.S. PATENT DOCUMENTS

| | | | | | |
|---|---|---|---|---|---|
| 5,071,060 | A | | 12/1991 | DeFelice | |
| D323,114 | S | * | 1/1992 | Sheehan | D9/420 |
| 5,169,014 | A | * | 12/1992 | Hexamer | 220/4.22 |
| 5,176,272 | A | * | 1/1993 | Ryan | 220/4.23 |
| 5,310,070 | A | | 5/1994 | Haas et al. | |
| D349,050 | S | | 7/1994 | Krupa | |
| 5,405,009 | A | * | 4/1995 | Hackenbracht | 206/470 |
| 5,445,397 | A | * | 8/1995 | Evans | 280/47.18 |
| 5,584,408 | A | * | 12/1996 | Orkisz | 220/4.23 |
| D388,324 | S | | 12/1997 | Bonnard | |
| 5,862,930 | A | | 1/1999 | Orkisz | |
| 5,954,203 | A | * | 9/1999 | Marconi | 206/464 |
| 5,996,787 | A | | 12/1999 | Kobayashi | |
| 6,054,159 | A | * | 4/2000 | Manzone | 426/134 |
| 6,220,442 | B1 | | 4/2001 | Merrell et al. | |
| 6,332,546 | B1 | * | 12/2001 | Hunt | 211/40 |
| D502,869 | S | * | 3/2005 | Clarke | D9/425 |
| 6,889,838 | B2 | * | 5/2005 | Meier et al. | 206/508 |
| D510,804 | S | * | 10/2005 | Horman | D3/304 |
| 7,073,680 | B2 | | 7/2006 | Boback et al. | |
| 7,243,813 | B2 | * | 7/2007 | Krueger | 220/571 |
| 7,243,815 | B2 | * | 7/2007 | Coppedge et al. | 220/769 |
| 7,284,673 | B2 | * | 10/2007 | Habeger et al. | 220/4.23 |
| D571,654 | S | * | 6/2008 | Maroofian et al. | D9/420 |
| 7,568,589 | B2 | | 8/2009 | Vovan | |
| D602,352 | S | | 10/2009 | Pendergrass et al. | |
| 7,712,626 | B2 | | 5/2010 | Vovan | |
| 2001/0002268 | A1 | * | 5/2001 | Hanson et al. | 426/106 |
| 2003/0047474 | A1 | * | 3/2003 | Dahlson | 206/423 |
| 2003/0192808 | A1 | | 10/2003 | Clarizio et al. | |
| 2006/0138020 | A1 | * | 6/2006 | Hubbs et al. | 206/764 |
| 2006/0144744 | A1 | * | 7/2006 | Rodriquez et al. | 206/509 |
| 2006/0237454 | A1 | * | 10/2006 | Clarke | 220/4.21 |
| 2006/0289549 | A1 | | 12/2006 | Vovan | |
| 2007/0095695 | A1 | * | 5/2007 | Smith | 206/425 |
| 2008/0020120 | A1 | * | 1/2008 | O'Donnell | 426/549 |
| 2008/0305218 | A1 | * | 12/2008 | Kahn | 426/91 |
| 2009/0206082 | A1 | | 8/2009 | Vovan | |

FOREIGN PATENT DOCUMENTS

| | | | | |
|---|---|---|---|---|
| EP | 0 420 429 | A1 | | 4/1991 |
| GB | 2195318 | A | * | 4/1988 |

OTHER PUBLICATIONS

Reynolds® Flip 'n Stack™ (discovered Dec. 18, 2007).
U.S. Appl. No. 29/314,444, filed Apr. 1, 2009.
U.S. Appl. No. 12/647,809, filed Dec. 28, 2009.
U.S. Appl. No. 29/314,444, Jun. 24, 2010 Notice of Allowance.
U.S. Appl. No. 12/647,809, Nov. 30, 2011 Non-Final Office Action.

* cited by examiner

DISPLAY AND STORAGE CONTAINER

BACKGROUND

1. Field

The disclosed subject matter relates to product packaging.

2. Description of the Related Art

Various food containers are known in the art, but many suffer from inconvenient design features that in many cases frustrate users and detract from the experience of those trying to access the food in these containers. Other containers are also known, but suffer from similar drawbacks.

SUMMARY

In accordance with some embodiments, a display container comprises a top portion, a bottom portion, and a hinge. The top portion can comprise generally triangular side walls, a front viewing face, and a top face. The bottom portion can comprise generally triangular side walls configured to be positioned in the same general plane as the triangular side walls of the top portion, a back face opposite the front viewing face, and a bottom face opposite the top face. The hinge can be provided between the top portion and bottom portion.

In some embodiments the display container can further comprise a securing feature on the bottom portion near the top of the back face and a corresponding securing feature on the top portion near the back of the top face, wherein the hinge is located at the base of the front viewing face. In further embodiments the securing feature on the bottom portion can comprise a receiving portion of a snap and the securing feature on the top portion can comprise an insert portion of a snap. In some embodiments the entire container can be molded as a single piece of plastic, or as separate pieces of plastic. Furthermore, some embodiments can comprise transparent plastic to advantageously allow display of products within the container. In some embodiments the bottom portion can comprise ridges inside the container along the bottom face, the ridges configured to support and space products within the container. In some embodiments the bottom portion can comprise a hinge and a securing feature that connects the top and bottom portions together, the securing feature located opposite the hinge. Furthermore, in some embodiments the securing feature can comprise a sticker that extends across a seam between the top and bottom portions. In some embodiments, the top and bottom portions further can comprise portions that flare out to create a contact interface between the top and bottom portions.

In some embodiments, a clamshell container can comprise a top and bottom section attached by a hinge on one end. The border between the top and bottom can be such that the border is higher at a rear end and lower at a viewing end. The hinge can be located at the viewing end. The bottom of the container can be shaped so as to present at least one product to be stored within the container at an angle. In some embodiments, the top and bottom portions can be connected by a sticker and/or at least one interlocking snap. The top and bottom portions can be connected along the rear end. The connection between the top and bottom portions can be reversibly connected along the rear end. In some embodiments, the container can be configured to hold baked goods. In some embodiments, the border between the top and bottom portions can be straight between the viewing and rear ends. The top and bottom portions further can flare outward where they meet.

In some embodiments, a container can comprise a first section and a second section. The first section can comprise a broad portion oriented horizontally with walls extending upward along its circumference, such that the walls' height is greatest at a rear end and lowest at a viewing end. The second section can comprise a broad portion oriented horizontally with walls extending downward along its circumference, such that the walls' height is greatest at a viewing end and lowest at a rear end. The walls and horizontal portions of the first and second sections can thus define a volume. Additionally, the sections can be attached by a hinge at the viewing end and an additional means to hold the sections together at least one other point. The first section can be shaped so as to present at least one product to be stored within the container at an angle.

In some embodiments, a method of storing and presenting products can comprise placing products onto a first section. The first section can comprise a broad portion oriented horizontally with walls extending upward along its circumference, such that the wall's height is greatest at a rear end and lowest at a viewing end. A second section can be placed on top of the first section. The second section can comprise a broad portion oriented horizontally with walls extending downward along its circumference so as to meet the walls of the first section. The first and second sections can be attached by a hinge at the viewing end and by a connecting means to hold the sections together at least one other point. The formed container can then be displayed in an orientation such that the hinge is low and proximal to the viewer. In further embodiments, the formed container can be placed on shelves. Additionally or alternatively, the container can be stacked with similar containers.

BRIEF DESCRIPTION OF THE DRAWINGS

The following drawings and the associated descriptions are provided to illustrate embodiments of the present disclosure and do not limit the scope of the claims.

DETAILED DESCRIPTION OF PREFERRED EMBODIMENTS

Although certain preferred embodiments and examples are disclosed below, inventive subject matter extends beyond the specifically disclosed embodiments to other alternative embodiments and/or uses of the invention, and to modifications and equivalents thereof. Thus, the scope of the inventions herein disclosed is not limited by any of the particular embodiments described below. For example, in any method or process disclosed herein, the acts or steps of the method or process may be performed in any suitable sequence and are not necessarily limited to any particular disclosed sequence. For purposes of contrasting various embodiments with the prior art, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein. The systems and methods discussed herein can be used anywhere.

Containers serve a number of functions aside from simply containing the products therein. Many useful containers allow their contents to be seen prominently. In the context of sales, useful containers present their contents in a flattering, beneficial light. Additionally, containers can provide a reliable means for protecting their contents, whether from external elements such as gases or extreme temperatures, from human elements such as thieves, or other undesirable agents. The embodiments disclosed herein provide many of these beneficial advantages.

Figure 1:
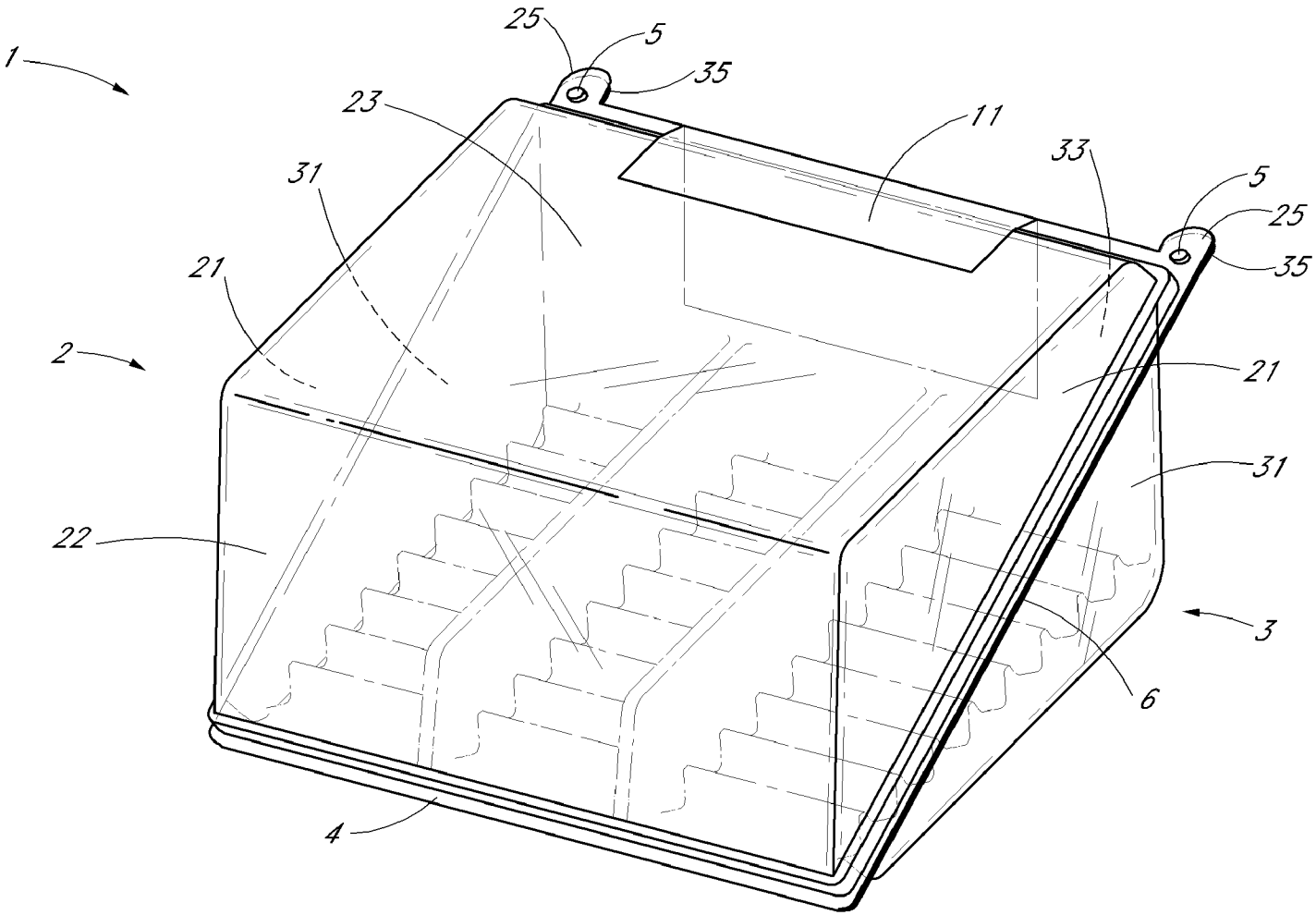
FIG. 1 is an elevated perspective view of a container.
Figure 2:
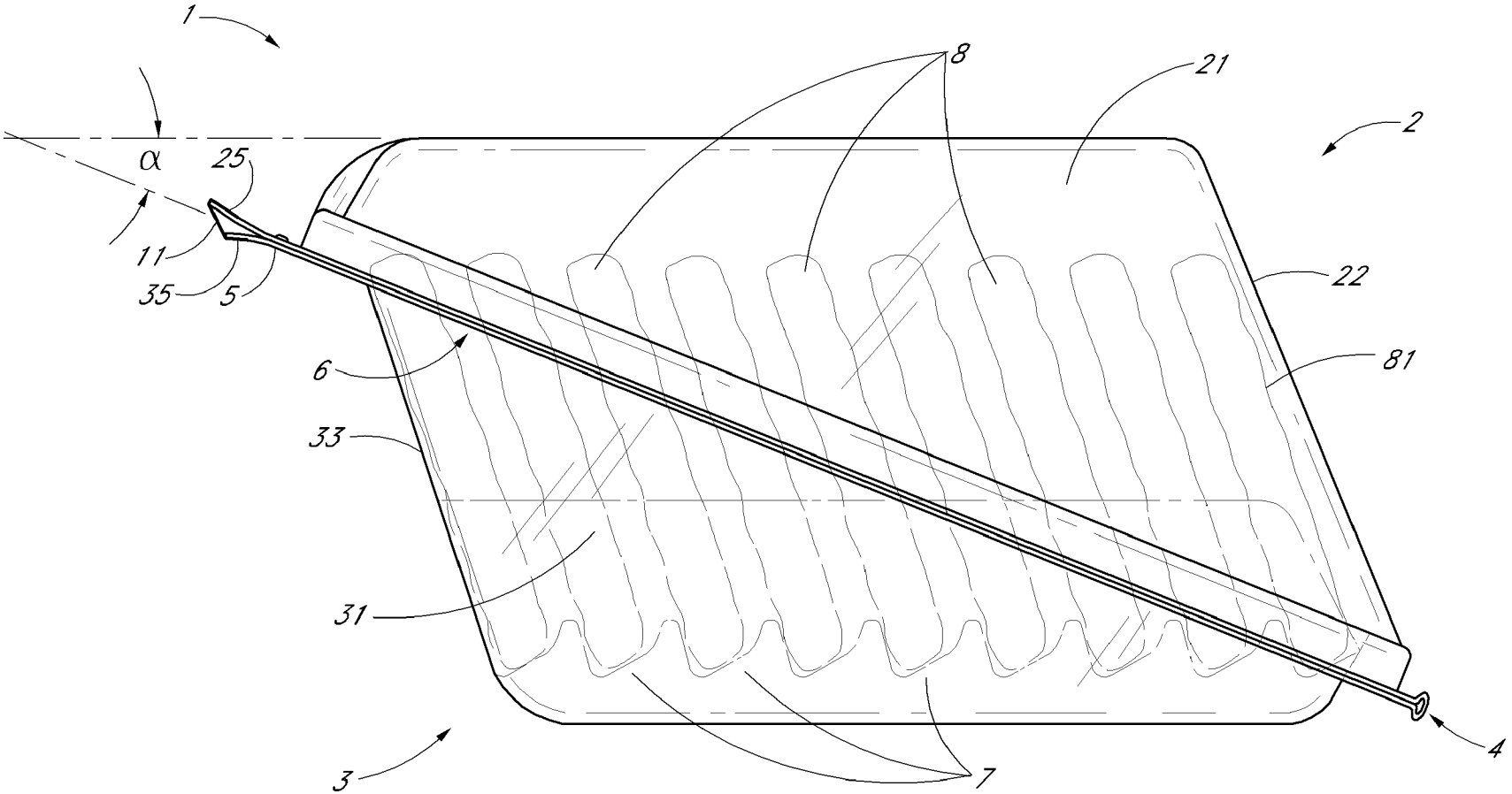
FIG. 2 is a side view of the container of FIG. 1.

FIG. 1 depicts an elevated perspective view of an embodiment of a product container 1. The container 1 comprises a top portion 2 and a bottom portion 3. The top portion 2 includes two substantially opposing side walls 21, and the bottom portion 3 also includes two substantially opposing side walls 31. The pairs of side walls 21, 31 can have a generally triangular shape, as illustrated. Although these triangular shapes are not pictured as right-triangles having an exact right angle, each still has a side that is longer than the other sides of that triangle and resembles a hypotenuse. On each side of the container 1, one of the side walls 21 can be positioned adjacent to one of the side walls 31 such that the "hypotenuses" of the two triangle shapes are aligned or positioned together. Thus, both full side walls of the container 1 resemble parallelograms formed from two triangles. FIG. 2 shows a plan view of one of the side walls depicting the generally triangular shapes discussed herein.

As further depicted in FIG. 1, the upper portion 2 has a viewing face 22 that extends between the two sides of the triangles forming the side walls 21. The viewing face 22 in the embodiment depicted is substantially rectilinear, but can also comprise other shapes such as a trapezoid, triangle, oval, or any other polyhedron or curved shape. Indeed, none of the shapes or configurations described herein are intended to be limiting, but only to provide example embodiments.

As further depicted in FIG. 1, the upper portion 2 also has a top face 23 that extends between the side walls 21. The top face 23 can also comprise a rectilinear or non-rectilinear shape, as explained with respect to the viewing face 22.

As further depicted in FIG. 1, the bottom portion 3 also has a back face 33 that extends between the two triangles forming the side walls 31. The back face 33 can also comprise a rectilinear or non-rectilinear shape, as explained with respect to the viewing face 22.

A sticker 11 can be attached to the container 1. The sticker 11 can attach to the top face 23 and extend to the bottom portion 3. Thus, the sticker 11 can secure the top portion 2 and bottom portion 3 together. The top portion 2 can also comprise snaps 5 as a reversible means for securing the top portion 2 and the bottom portion 3. The snaps 5 comprise interlocking ridges that can easily be locked and unlocked by human hands. When combined, the top portion 2 and bottom portion 3 define a shape substantially similar to a parallelepiped. The closed container 1 can also substantially resemble other shapes, such as a cylinder, pyramid, or prism, and still be consistent with the disclosed inventions. Notably, when the closed container 1 does not resemble a parallelepiped, the faces 21-23, 31, 33 may comprise multiple planar sections (e.g. a square cupola) or unclear borders between the faces (e.g. a cylinder).

In some embodiments, the top portion 2 and bottom portion 3 flare out along the seams 6, along the hinge 4, and at the rear end near the snaps 5. When seated against each other, the flared sections of the top and bottom portion can create a seal or an interference fit separating the interior of the container 1 from external elements. Depending on how important it is to provide an air-tight environment in any particular container, the flared sections can be increased, reduced, or eliminated. Other mechanisms can also be used to create a substantial seal including further interlocking ridges and compressible materials.

Figure 3:
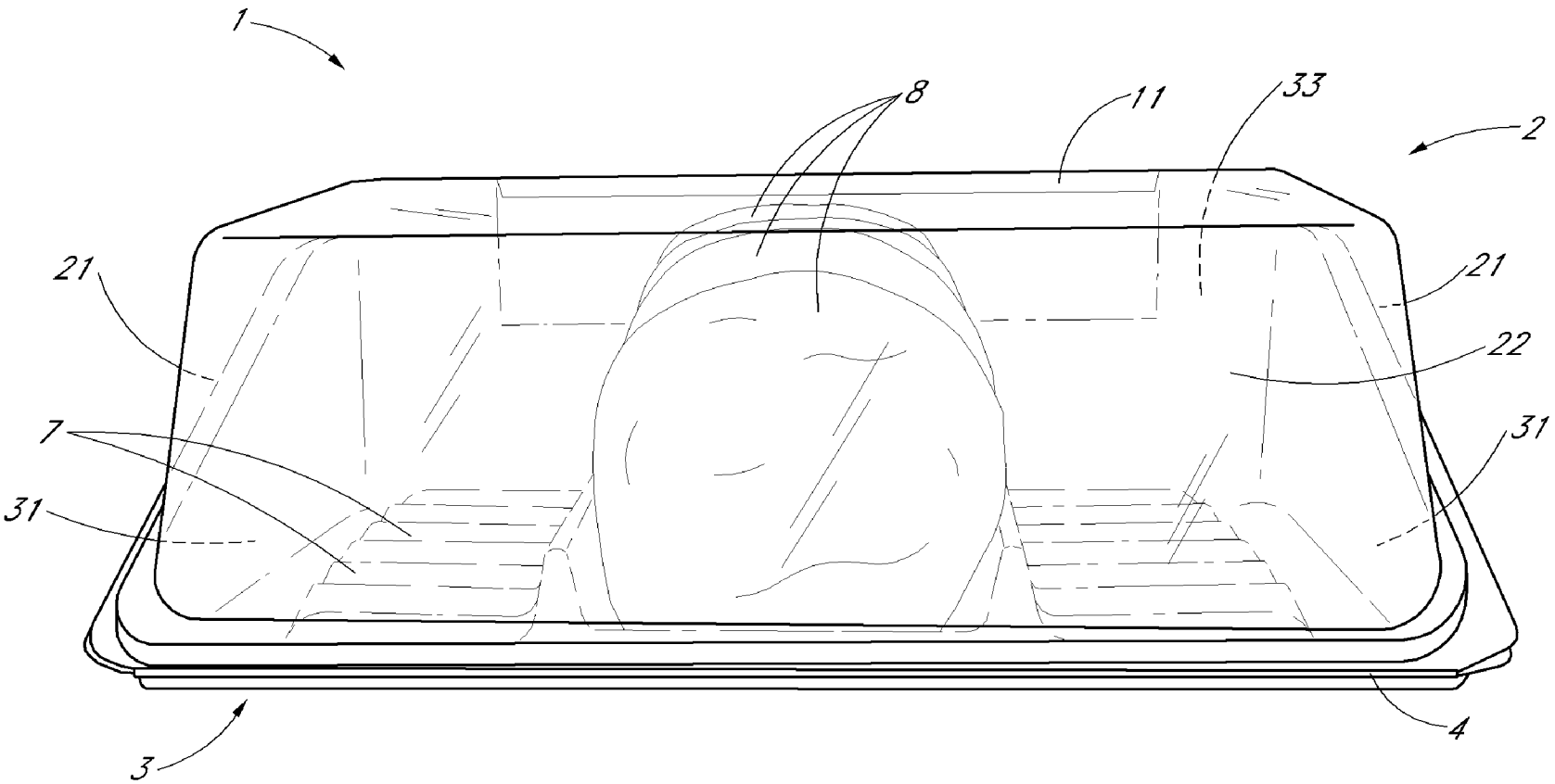
FIG. 3 is a front view of the container of FIG. 1.
Figure 5:
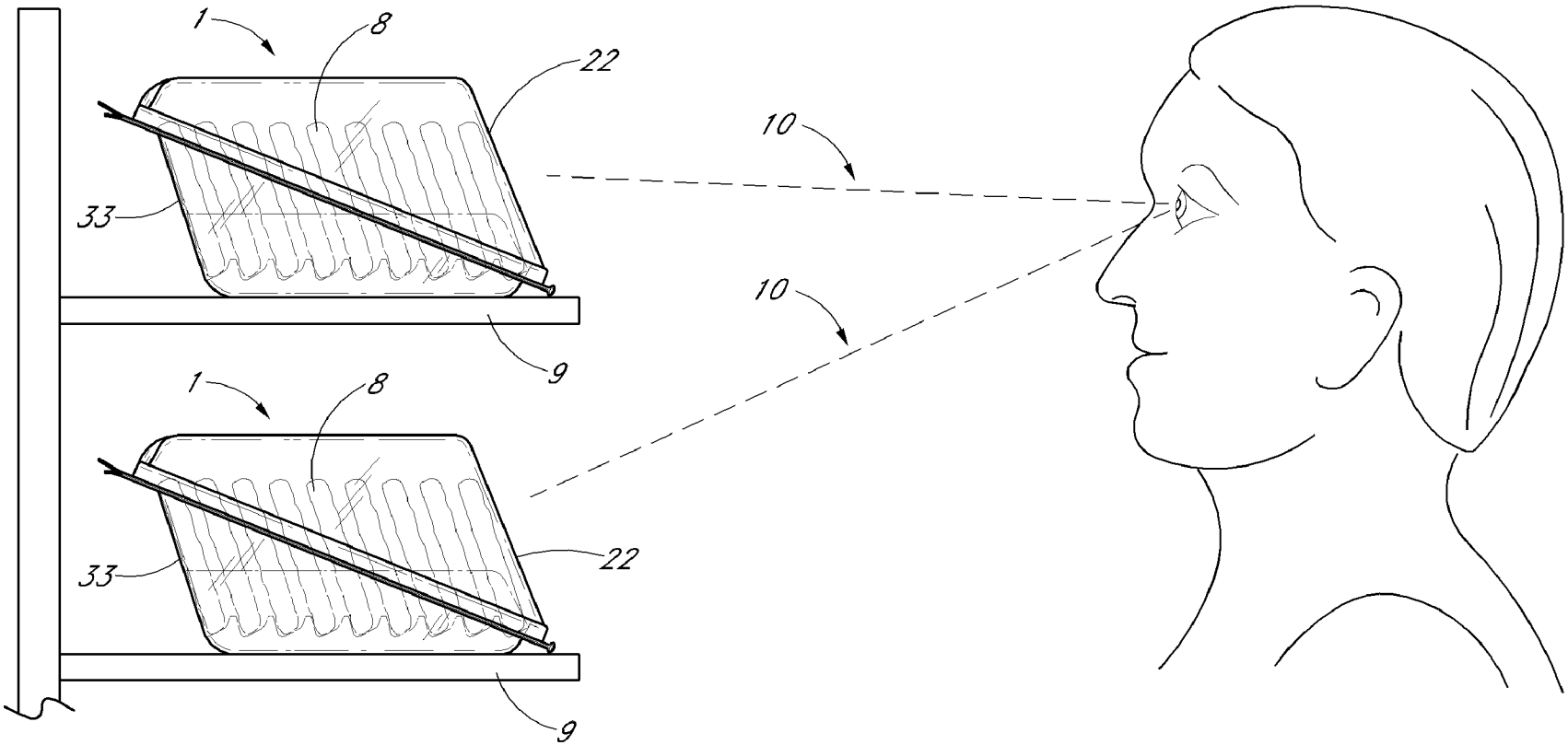
FIG. 5 is a side schematic view of how a container can be viewed.

At the viewing end of some embodiments of the container 1 (defined in this embodiment by the viewing face 22), the top portion 2 and bottom portion 3 are connected at a hinge 4. The hinge 4, the top portion 2, and the bottom portion 3 can all be molded from the same material. The hinge 4 can thus be formed upon folding together the simultaneously molded pieces 2 and 3. However, the hinge 4 can also comprise some other material or apparatus molded with, adhered to, or attached to the top portion 2 and the bottom portion 3. In some advantageous embodiments, the hinge 4 is sufficiently resilient to withstand multiple openings and closings of the container 1. In some embodiments the hinge 4 is advantageously located near the bottom of the container 1, so as not to obstruct the view of the products 8 through the viewing face 22, as shown in FIGS. 2, 3, and 5.

At the rear end of the container 1 (opposite the viewing end) the top portion 2 and bottom portion 3 can be connected by a combination of snaps 5 and a sticker 11. A sticker is a desirable method for connecting the top portion 2 and bottom portion 3 because the integrity of the sticker indicates that a container 1 has not been opened since being initially loaded and closed. Thus, one can presume that no one has tampered with the contents of the container 1 and that the contents have not been exposed to external elements. The snaps 5 provide a convenient way to reseal the container 1 after opening it to remove something stored therein. This can allow a user to preserve the freshness of any remaining container contents. Other securing means and combinations thereof can be used, including staples, adhesives, Velcro®, or any other means known in the art, reversible or otherwise.

FIG. 2 provides a side view of an embodiment of a container 1. In between the lower and upper corners the top portion 2 and the bottom portion 3 meet along a seam 6 that extends at an angle $\alpha$ relative to the top and bottom of the container 1. The seam 6 need not comprise a straight line between the upper and lower corners, but can also be curved or bent. FIG. 2 also illustrates products 8 (shown here as cookies) inside the container 1. The container 1 can also be configured to hold various other products, including other baked goods such as slices of pound cake.

FIG. 2 also shows how the interior of the container 1 can be designed to present the products 8 at desirable angles. For example, cookies and other substantially planar products can be presented standing at a slight angle, allowing a viewer to see the top of a cookie 8 directly behind the viewing panel 22. To hold these products 8 in the desired position 81, the bottom portion 3 can contain ridges 7 shaped to support the products 8. Products 8 with other geometries can be held in similarly desirable positions with appropriately shaped ridges 7 or some other shape, including a flat bottom. The products 8 may also rest against each other and/or the walls of the container 1 to stay in the desired position 81.

When the products 8 rest against the walls of the container 1, the walls can be shaped to advantageously receive the products so as to prevent damage during transport. In the embodiment depicted in FIG. 2, the walls 22, 33 are shaped to substantially match the products 8. Thus in the event of a sudden movement or impact, the forces on the products 8 can be more evenly distributed at the interface between the products and the walls 22, 33. This can vastly reduce the probability of loss of product integrity upon such sudden movements and impacts.

FIG. 3 illustrates how products 8 can be seen through the viewing face 22 of a container 2. As shown, one can choose to locate the securing means elsewhere on the container 2 so as to improve visibility of the products 8 from side viewing angles such as that depicted in FIG. 2, as well as front viewing angles 10 (see FIG. 5) such as the view depicted in FIG. 3. Placement of sticker 11 on the rear end obstructs views from the rear through the back face 33, but not from the front, top, or sides. The sticker 11 or other securing means need not be located along the rear end of the container 1, but instead can be located along the seams 6 or near the hinge 4. It may also be desirable to provide securing means along both the rear end and the seams 6 to create a better seal. As further illustrated in FIG. 3, the hinge 4 is preferably located at or near the bottom of the container 1. Importantly, placement of the hinge 4 along the bottom allows for clear viewing through viewing face 22 and through top face 23.

Figure 4:
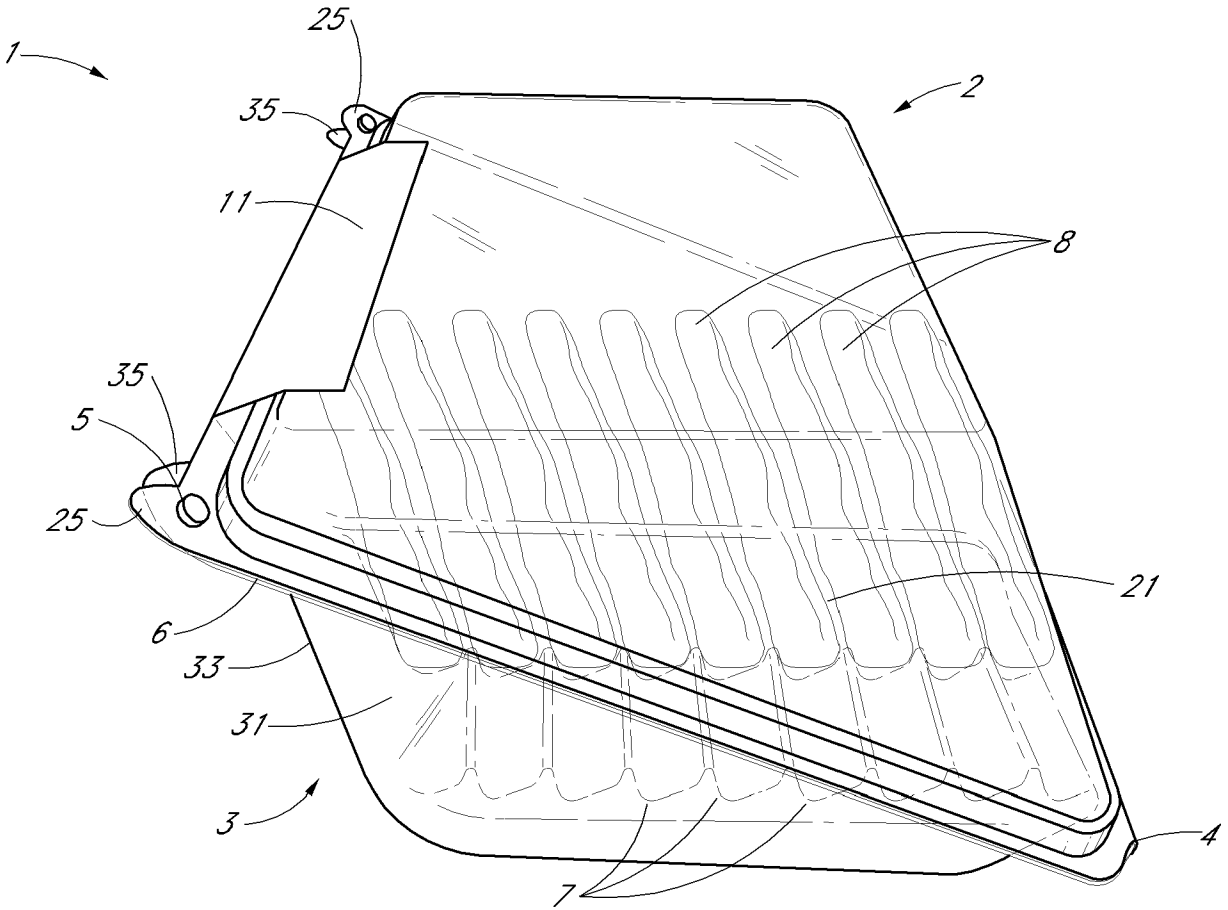
FIG. 4 is a perspective view of the container of FIG. 1.

FIG. 4 illustrates a side elevational view of a container 1, where the view of the products 8 is substantially unobstructed by the sticker 11. However, the sticker 11 in this position, while not substantially obstructing the view of the products 8, can still remain prominent to a viewer. In some embodiments the sticker 11 can comprise printed text and/or graphics. Therefore, the sticker 11 in this position can simultaneously convey information and not obstruct the view of the products 8, a significant advantage over the prior art. Similar results can be accomplished with a sticker 11 provided at other parts of the container 1, as described herein.

FIG. 5 depicts containers 1 on shelves 9, where they are visible to a passer-by. The sight-lines 10 show how the viewing panel 22 (and products 8) can be seen. Some embodiments provide a method for displaying products in containers. FIG. 5 depicts containers 1 arranged on shelves 9, such as at a department store or grocery store. To allow space for more products it is often desirable to minimize space between shelves 9. Minimizing this space limits a potential customer's field of view to angles 10. In some embodiments, a vendor can display products 8 in containers 1 that provide a substantially unobstructed view of their contents in an orientation such that potential customers view said containers 1 at the appropriate angle. This disclosure and the described embodiments are not limited to use with compact shelving, but can also be used in other situations such as stacked containers or containers placed on tables.

When a potential customer views the products 8 from above, an unobstructed view 10 can be provided through a slanted wall 22, through a top wall 23, or through other walls present in embodiments with other geometries. When a potential customer views the products 8 from substantially straight-on, an unobstructed view 10 can be provided through a slanted wall 22, or alternatively a curved wall, a wall perpendicular to the base 21, 31, or other shapes. In either case, the hinge 4 can be provided toward the bottom of the container 1 so as not to obstruct the view 10 of the products 8, and thus increasing the probability of a sale.

However, in some embodiments it may be desirable to locate the hinge at a higher position. Providing the hinge at too low a position may allow the container 1 to comprise too low an opening. Thus, products 8 could undesirably fall out of the container 1 through a low opening near a low hinge 4. Similarly, such a low opening may allow undesirable dust and debris to easily enter the container 1 while open, spoiling the freshness and cleanliness of the products 8. In conformity with some of the inventions described herein, the container 1 can comprise a hinge 4 placed at a height chosen to balance the desired attributes described, along with other considerations. For example, this height may be approximately 3 inches. This height may be approximately 75% or greater of the total height of the container.

Figure 6:
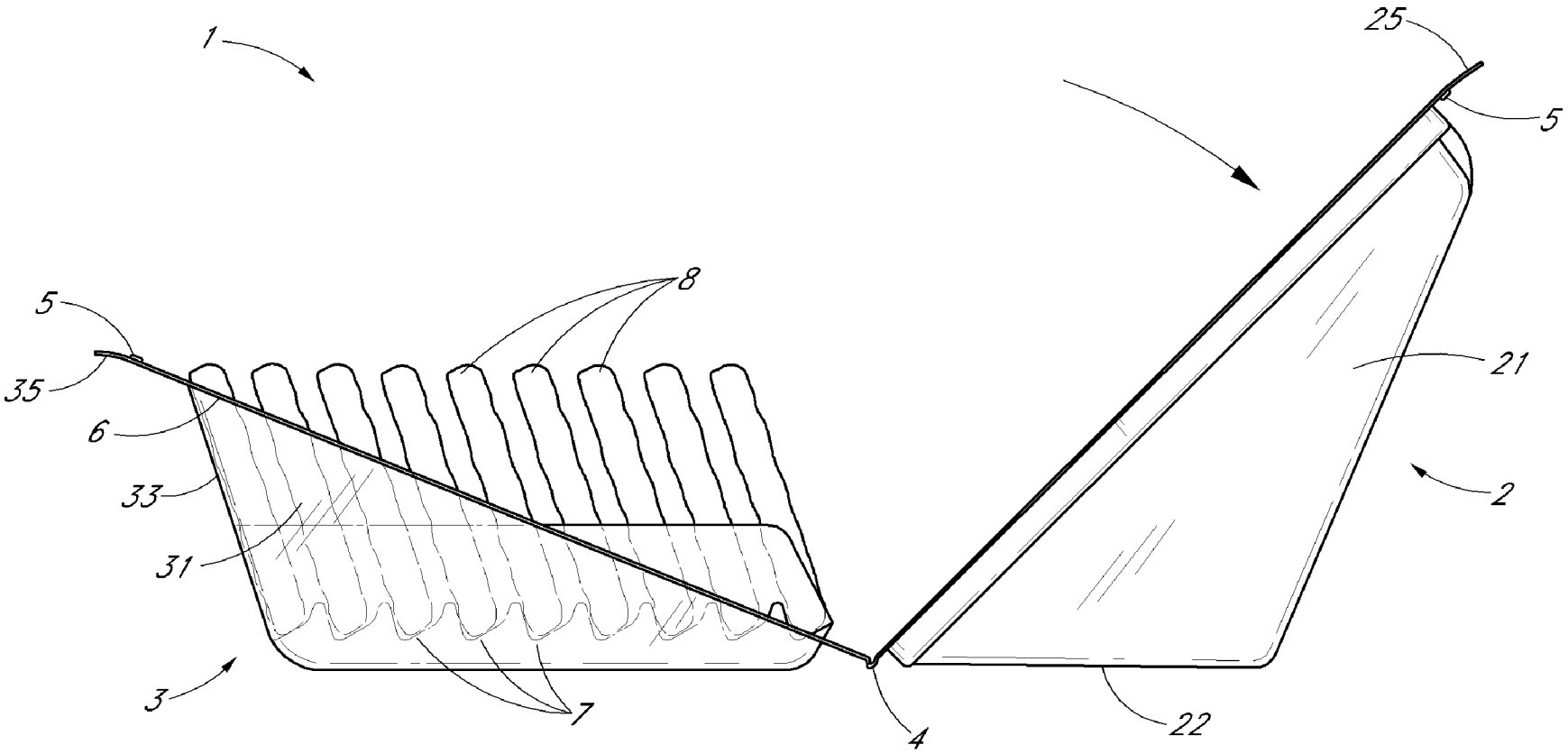
FIG. 6 is a side view of an open container.

FIG. 6 depicts a side view of a container 1 opened. As shown, in some embodiments, the container 1 opens from the rear—opposite the viewing panel 22. The top portion 2 can rotate around the hinge 4, while the bottom portion 3 remains at rest, allowing the product to be stable as the container 1 is opened. The orientation of the viewing face 22 above the hinge 4 (and opposite the snaps 5) is not required.

The illustrated embodiments have further advantages. For example, if the snaps 5 are located at the rear of the container 1, they may be less likely to interfere with the view of the product 8. Moreover, the snap 5 may secure the top portion 2 and the bottom portion 3 together so effectively that to open the container 1, a user must grip the container 1 very firmly on the portion immediately adjacent the snaps 5. Positioning the snaps 5 in an elevated position can make the container 1 easier to open by providing ample space for a person to position his or her hand on a surface adjacent to the base of the container 1 with the thumb and forefinger gripping the container near the snap 5. The other hand can grip the upper portion 2 near the snap 5 and pull the upper portion 2 up to open the container. This way, one of the user's hands remains in place on the surface, along with the bottom portion 3 containing the products 8. Thus, this configuration provides a stable, convenient option for the mechanics of opening a container 1.

If the container 1 opens from a lower seam, a user may need to lift the container 1 so as to get their hand beneath the container to open it. This raising of the container 1 can make opening it substantially more difficult and/or inconvenient. For example, raising the container 1 while opening it enhances the probability of spilling the contained products 8 because (1) the container 1 is no longer stabilized against a lower surface upon which it could otherwise rest, and (2) if the container is lifted only on the opening end then it will be tilted, causing the products 8 to fall out on the opposite end.

To further improve the mechanics of opening a container 1, the portions immediately adjacent the snaps can protrude to form gripping portions 25, 35 such as tabs, for example. The gripping portions 25, 35 can be integral with the flared portions discussed above. Alternatively, the gripping portions can comprise handles, levers, or other protrusions specifically designed to improve grip, independent of the flared portions. In some embodiments, the gripping portions 25, 35 can further comprise a highly texturized and/or roughened surface to improve a user's ability to grip.

The illustrated configuration can also have useful attributes while the container 1 is being displayed in a store. For example, it can be more difficult for a thief to open a container and pilfer a product contained therein, without first reaching up and removing the container 1 from the shelf to make the snaps more accessible. Alternatively, a thief may have to turn the container around. Either of these actions can call unwanted attention to a potential thief. Thus, potential thieves may be deterred from opening containers in accordance with the described embodiments. Opening from the back will be even more difficult when the containers 1 are provided as in FIG. 5 with little clearance between shelves 9.

Figure 7:
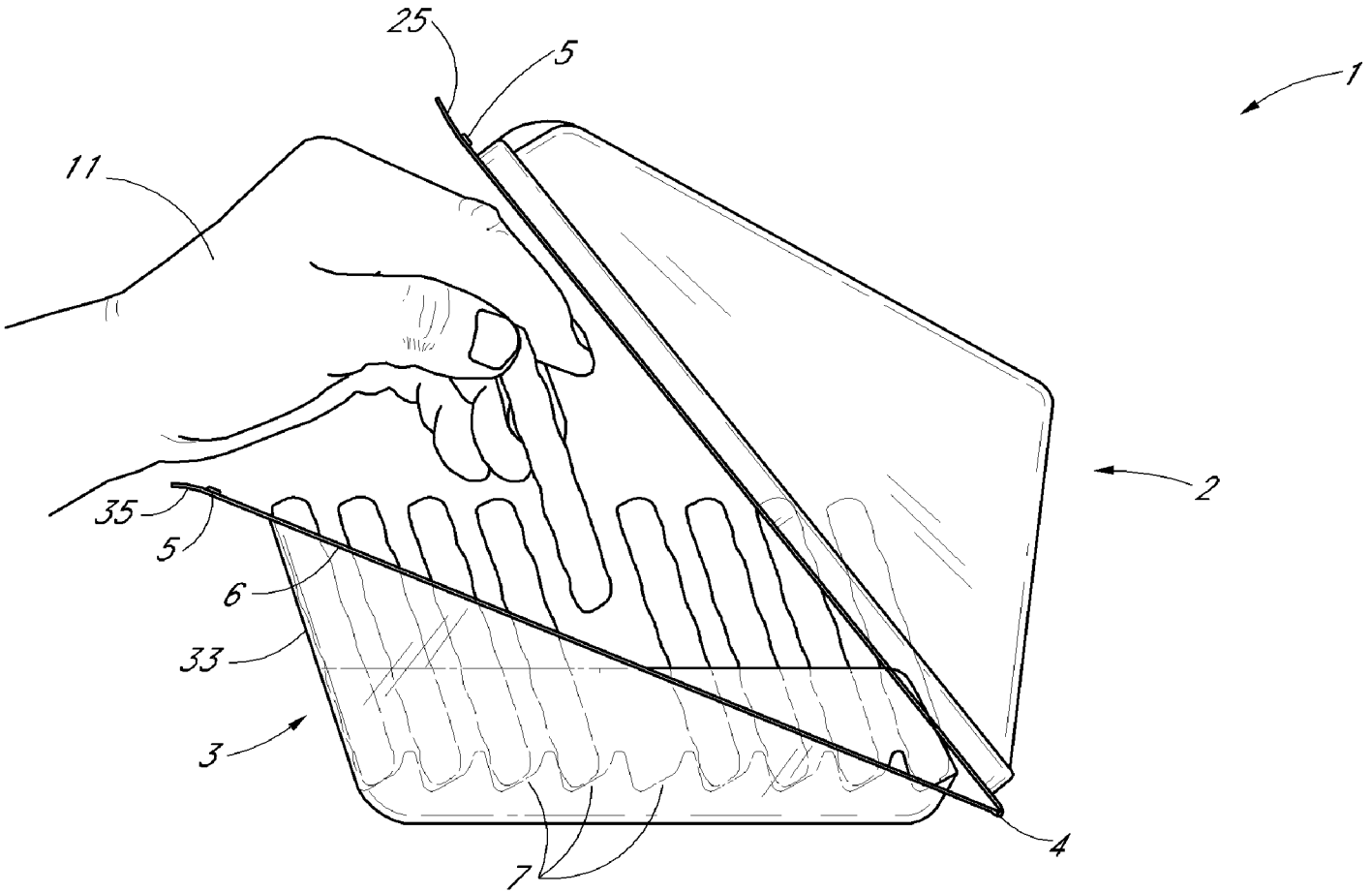
FIG. 7 is a side view of showing how a product can be removed from a container.
Figure 8:
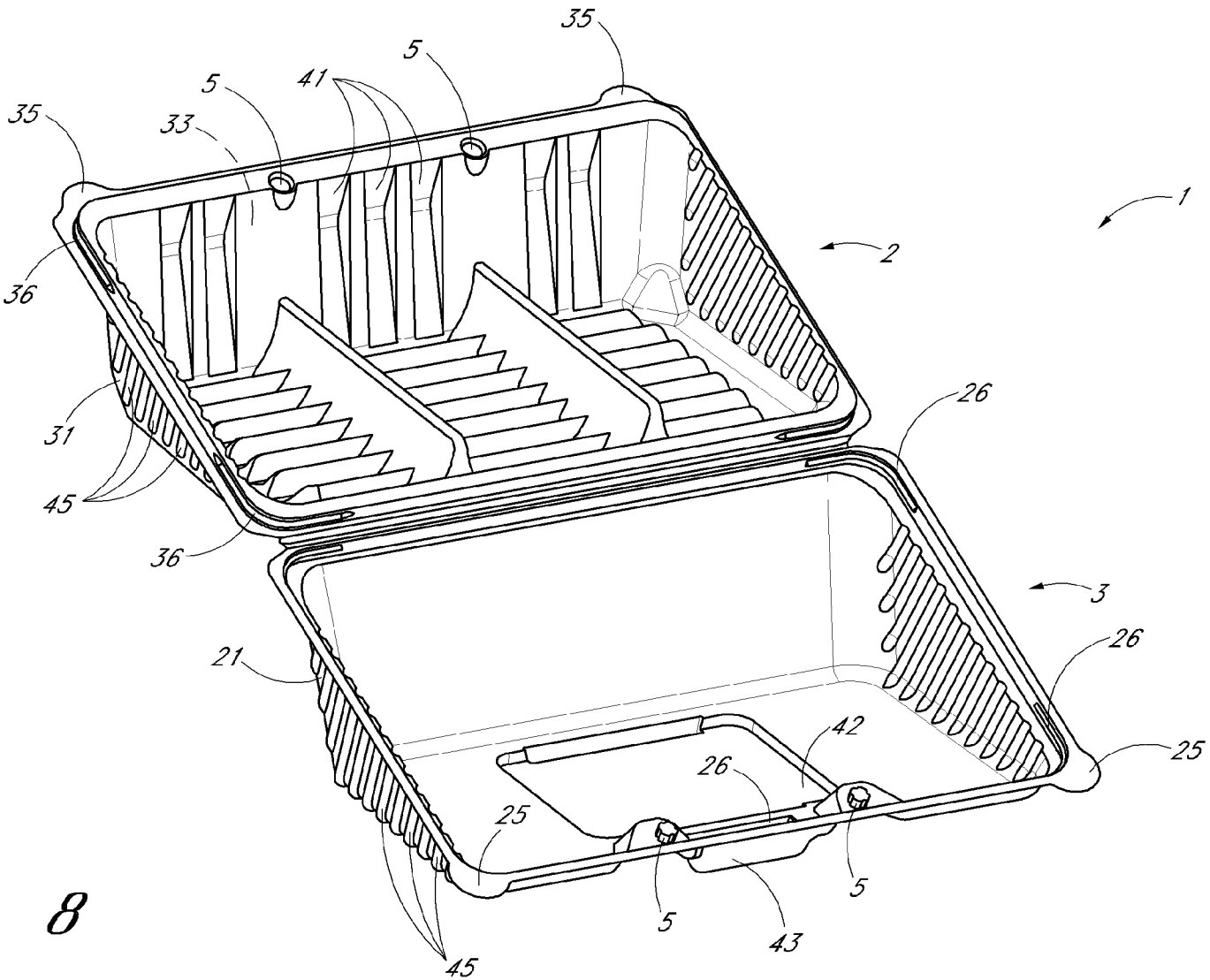
FIG. 8 is an isometric view of an embodiment of an open container.

FIG. 7 illustrates how products 8 can be removed from an open container. When not on shelves 9, some embodiments provide a substantial advantage for accessing products 8 presented with a slight backward lean, as shown in FIG. 7. Products 8 in such a position are most easily picked up from the back. Containers that open from the front may require one to reach around the product 8 to pick it up. However, as depicted in FIG. 7, when the container 1 opens from the back a hand 11 can easily pick up any one of the products 8 while only slightly opening the container 1. This not only provides easier access to the products 8, but also allows access without unnecessarily exposing said products 8 to external elements, thus preserving the freshness of the products 8.

Figure 9:
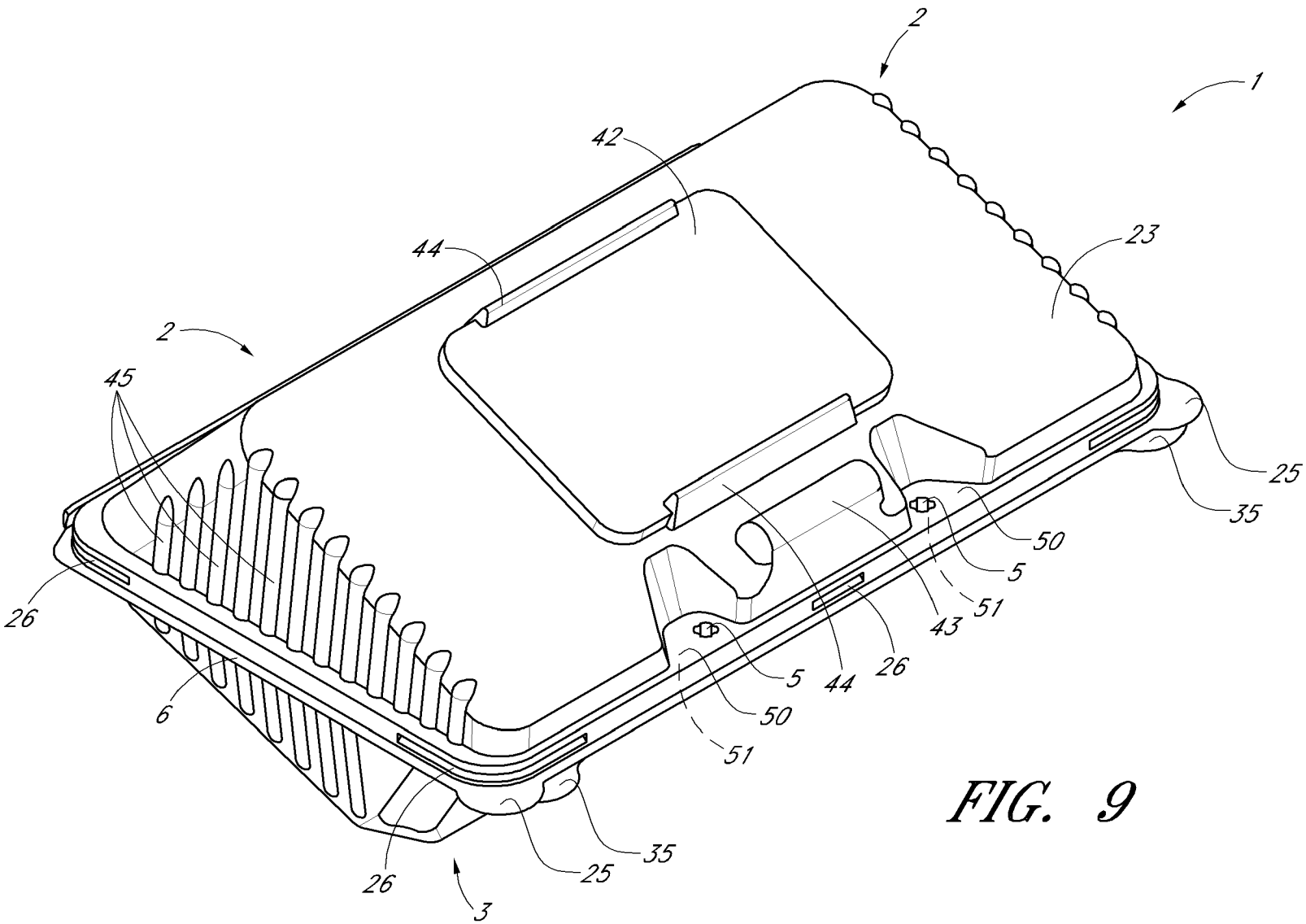
FIG. 9 is an isometric view of a closed container.
Figure 10:
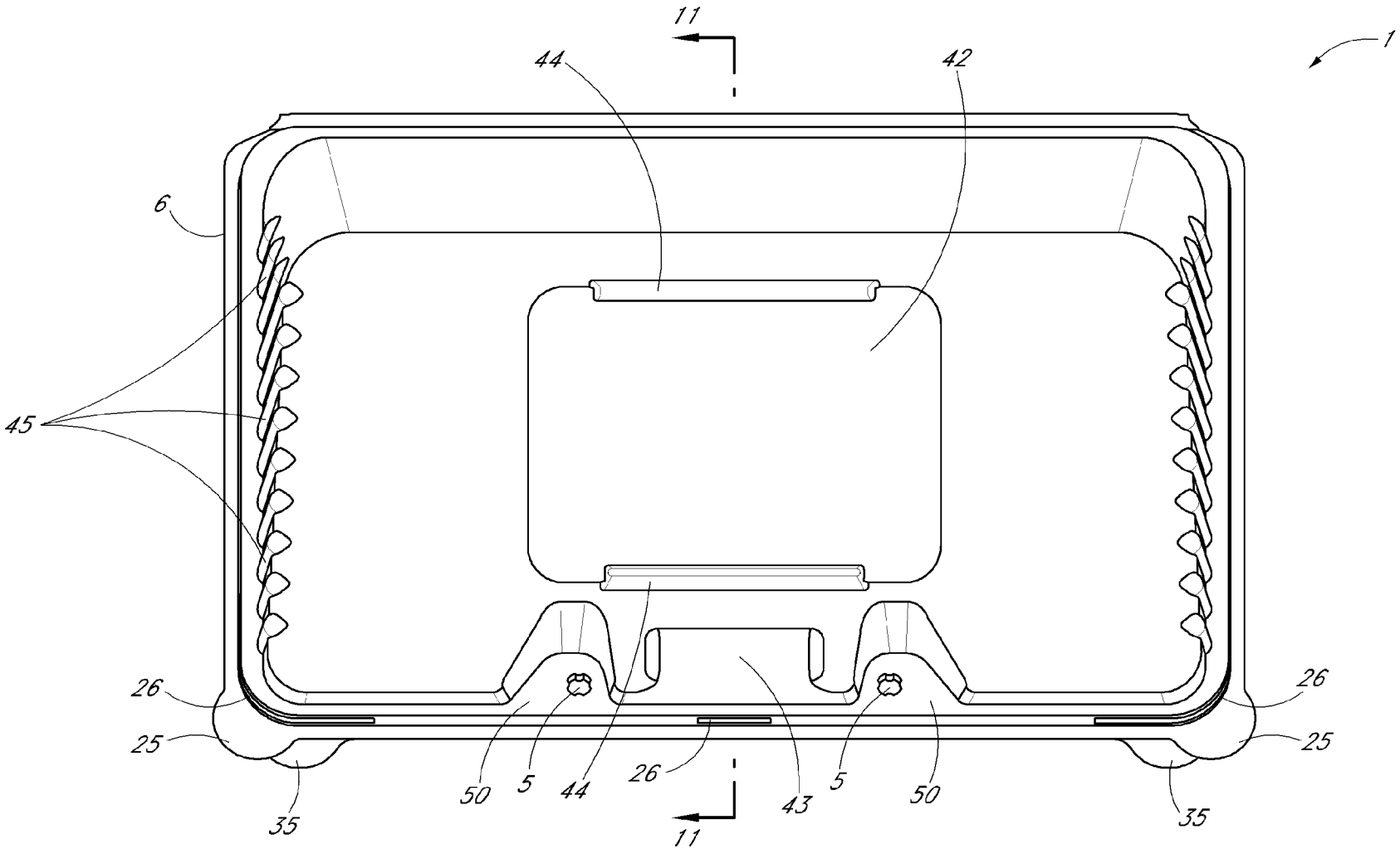
FIG. 10 is a top view of the container of FIG. 9.
Figure 11:
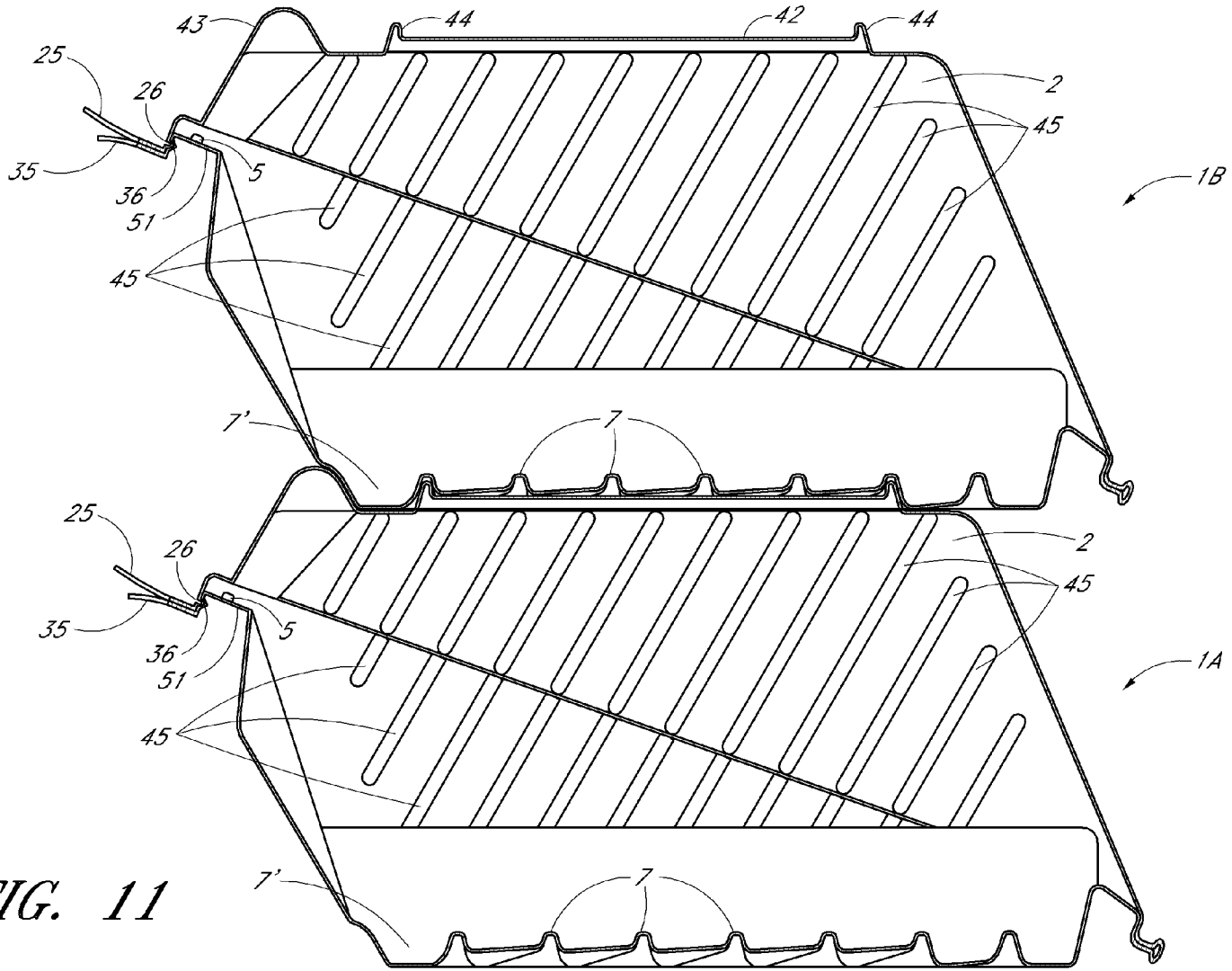
FIG. 11 is a cross-sectional side view of multiple stacked containers.

FIGS. 8-11 illustrate an alternative embodiment of a container 1. The container 1 can comprise snaps 5. In contrast to FIG. 1, where the snaps 5 are located near the grip portions 25, 35, in this embodiment the snaps 5 are located farther away from the grip portions 25, 35. The snaps 5 can be positioned near the flared portion of the seam 6 (see FIGS. 9, 10) near the rear of the container 1, as shown. Further, the snaps 5 can be positioned within indentations 50, as shown most clearly in FIG. 10. Each indentation 50 can provide a substantially flat surface surrounding each snap 5. For example, as best shown in FIGS. 9 and 11, snaps located in the top surface 23 would not effectively meet their counterpart snaps 5 in the bottom portion 3 if the top surface 23 did not dip down at the indentations 50. Thus, the indentations 50 comprise a surface surrounding the upper half of the snaps 5, and that surface is substantially parallel to the surface 51 surrounding the lower half of the snaps 5. The indentation 50 can further provide sufficient finger and/or thumb access and space to pinch the snaps together.

As further shown in FIGS. 8-11, the container 1 can comprise additional closure structures positioned generally along the seam 6. For example, elongated receiving ridges 26 can be configured to receive elongated insertion ridges 36. As shown, the receiving ridges 26 and the insertion ridges 36 can help provide a seal for the container 1, and in some embodiments, the ridges 26, 36 can be located at the corners and in the rear of the container 1, supplementing the closure function of the snaps 5. Additional or fewer snaps may be provided, and they may be positioned differently from the manner illustrated, depending, for example, on the desired strength of adherence between the top and bottom portions 2, 3.

The side faces 21 and 31 can comprise ribs 45. The back face 33 can comprise ribs 41. The ribs can be oriented perpendicular to the intersecting seam 6, and can be positioned so as to avoid interference with other elements, such as the snaps 5. The size and number of ribs can be chosen according to desired strength, cost, appearance, spacing, and other characteristics of interest. Ribs can be especially useful in providing structural strength and rigidity for containers that may bear the weight of additional containers stacked on top (see, e.g., FIG. 11).

As shown (for example, in FIG. 9), the container 1 can additionally comprise a raised portion 42 along the top face 23 of the top portion 2. The raised portion 42 can further comprise a message or logo molded in relief into the material of the container 1. Alternatively, the raised portion 42 can act as a convenient location for a sticker.

FIG. 11 shows a cross-sectional view of two containers 1 stacked on top of each other. The top portion 2 can comprise holding portions 44. These holding portions can be shaped to interact with the bottom, inverse portion of the ridges 7. Thus, a second container 1B may be placed directly on top of a first container 1A, such that the ridges 7 of container 1B may interact with the holding portions 44 to keep the top container 1B from sliding off the bottom container. Additionally, the top portion 2 may comprise a stop portion 43 to interact with a final ridge 7' of the container 1. Because the stop portion 43 in this embodiment abuts only one side of the final ridge 7', it does not need to fit between adjacent ridges, and can thus be wider than the holding portions 44. In some embodiments, the space between the stop portion 43 and holding portion 44 can be shaped so as to fit precisely one ridge 7, that being the final ridge 7'. The final ridge 7' may further be specially shaped larger than the other ridges, providing a potentially stronger stop against sliding between the stacked containers 1A, 1B.

The container 1 can comprise materials such as polystyrene, polypropylene, polyethylene, terephthalate, polylactide, polyvinyl chloride, other plastics, other thermoplastic polymers, other polyester polymers, other biodegradable and/or compostable rigid polymers, or any other moldable material or combination thereof. It will often be desirable to choose a transparent material to maximize the clarity of the products 8 contained. However, in some embodiments it may desirable to include translucent or opaque materials for aesthetic or functional reasons.

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

In the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment.

Although the invention(s) presented herein have been disclosed in the context of certain preferred embodiments and examples, it will be understood by those skilled in the art that the invention(s) extend beyond the specifically disclosed embodiments to other alternative embodiments and/or uses of the invention(s) and obvious modifications and equivalents thereof. Thus, it is intended that the scope of the invention(s) herein disclosed should not be limited by the particular embodiments described above.

What is claimed is:

1. A display container comprising:

a top portion having generally triangular side walls, a front viewing face, and a top face;

a bottom portion having generally triangular side walls configured to be positioned in the same general plane as the triangular side walls of the top portion, a back face opposite the front viewing face, and a bottom face opposite the top face, the back face extending upwardly and rearwardly from the bottom face, the bottom face comprising a plurality of ridges inside the container to support and space a plurality of products within the container between the ridges, each ridge having a ridge wall extending from the bottom face to support a respective product at an angle substantially parallel to the back face, wherein each product is spaced from an adjacent product by a ridge disposed therebetween, the bottom face further comprising one or more dividers comprising a height greater than a height of the ridges, the one or more dividers dividing the ridges into a plurality of rows; and a hinge between the top portion and bottom portion.

2. The display container of claim 1, further comprising a securing feature on the bottom portion near a top of the back face and a corresponding securing feature on the top portion near a back of the top face, wherein the hinge is located at the base of the front viewing face.

3. The display container of claim 2, wherein the securing feature on the bottom portion is a receiving portion of a snap and the securing feature on the top portion is an insert portion of a snap.

4. The display container of claim 2, wherein the entire container is molded as a single piece of plastic.

5. The display container of claim 4, wherein the plastic is transparent to allow display of products within the container.

6. The display container of claim 1, wherein the top portion comprises at least one holding portion shaped to interact with the ridges in the bottom portion of a similar container when stacked on top of the display container.

7. The display container of claim 6, wherein the top portion of the container comprises at least one stop portion shaped to prevent a similar container from sliding backwards when stacked on top.

8. The display container of claim 1, further comprising a hinge and a securing feature that connects the top and bottom portions together, the securing feature located opposite the hinge.

9. The display container of claim 8, wherein the securing feature is a sticker that extends across a seam between the top and bottom portions.

10. The display container of claim 1, wherein the top and bottom portions further comprise portions that flare out to create a contact interface between the top and bottom portions.

11. The display container of claim 1, wherein the back face is substantially parallel to the viewing face when the top portion is in a closed position to support a further product at an angle substantially parallel to the viewing face.

12. The display container of claim 11, wherein the top and bottom portions are further connected by a securing feature.

13. The display container of claim 11, wherein the top and bottom portions are further connected by at least one interlocking snap.

14. The display container of claim 11, wherein a border is defined between the top and bottom portions, wherein the border is higher at a rear end and lower at the viewing face, and the top and bottom portions are connected along the rear end.

15. The display container of claim 14, wherein the border between the top and bottom is straight between the viewing face and the rear end.

16. The display container of claim 14, wherein the top and bottom portions flare outward at the border.

17. A container comprising:

a first section comprising a back face and a first broad portion oriented horizontally with first side walls extending upward along its circumference, such that the first side walls progressively increase in height toward the back face;

a second section comprising a viewing face and a second broad portion oriented horizontally with second side walls extending downward along its circumference, such that the second side walls progressively increase in height toward the viewing face;

the first and second sections together defining a volume therebetween; wherein, the first section and second section are attached by a hinge proximate the viewing face for movement of the second section between an open position and a closed position and by at least one interlocking snap to hold the sections together at at least one other point;

the first section includes a bottom surface, the back face extending upwardly and rearwardly from the bottom surface substantially parallel to the viewing face when the second section is in the closed position to support a product at an angle substantially parallel to the viewing face; and the first broad portion comprises a plurality of ribs configured to interengage with a plurality of ribs on the second broad portion of a similar container when stacked.

18. The display container of claim 1, wherein the plurality of products is a plurality of baked products.

19. The display container of claim 18, wherein the plurality of products is a plurality of cookies.

20. A display container comprising:

a top portion having generally triangular side walls, a front viewing face, and a top face;

a bottom portion having generally triangular side walls configured to be positioned in the same general plane as the triangular side walls of the top portion, a back face opposite the front viewing face, and a bottom face opposite the top face, the back face extending upwardly and rearwardly from the bottom face, the bottom face comprising a plurality of ridges inside the container to support and space a plurality of products within the container between the ridges, each ridge having a ridge wall extending from the bottom face to support a respective product at an angle substantially parallel to the back face, wherein each product is spaced from an adjacent product by a ridge disposed therebetween;

a hinge between the top portion and the bottom portion; and at least one reversible snap connecting the top portion and the bottom portion.

21. The display container of claim 20, wherein at least two of the reversible snaps are at respective corners of the display container.

22. The display container of claim 21, wherein the snaps comprise elongated ridges.

23. The display container of claim 20, wherein the top portion comprises a plurality of ribs configured to interengage with a plurality of ribs on a bottom portion of a similar container when stacked.

24. The display container of claim 1, wherein the top face comprises a plurality of ribs configured to interengage with a plurality of ribs on a bottom face of a similar container when stacked.

25. The display container of claim 11, wherein the top portion comprises a plurality of ribs configured to interengage with a plurality of ribs on a bottom portion of a similar container when stacked.

26. The display container of claim 1, wherein the side walls comprises ribs oriented perpendicularly to a border between the top and bottom portions along the side walls.

27. The display container of claim 14, wherein the container comprises ribs oriented perpendicularly to and adjacent to the border.

28. The container of claim 17, wherein the first and second side walls comprise ribs adjacent and oriented perpendicularly to a border between the first and second portions.

29. The display container of claim 20, wherein the side walls comprise ribs oriented perpendicularly to a border between the top and bottom portions along the side walls.

* * * * *